US007175266B2

(12) United States Patent
Helterline

(10) Patent No.: US 7,175,266 B2
(45) Date of Patent: Feb. 13, 2007

(54) REPLACEABLE MEMORY DEVICE FOR A CONSUMABLE SUBSTANCE CONTAINER, AND METHODS

(75) Inventor: Brian L. Helterline, Salem, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 250 days.

(21) Appl. No.: 10/769,336

(22) Filed: Jan. 30, 2004

(65) Prior Publication Data

US 2005/0168544 A1 Aug. 4, 2005

(51) Int. Cl.
*B41J 2/175* (2006.01)

(52) U.S. Cl. ..... 347/86; 347/85; 347/19

(58) Field of Classification Search ..... 347/19, 347/85, 86

See application file for complete search history.

(56) References Cited

U.S. PATENT DOCUMENTS 5,992,975 A 11/1999 Gasvoda et al.
6,168,262 B1 1/2001 Clark et al.
6,183,077 B1 * 2/2001 Hmelar et al. ..... 347/86
6,312,106 B1 * 11/2001 Walker ..... 347/50
6,585,345 B2 * 7/2003 Kosugi ..... 347/19
6,808,255 B1 * 10/2004 Haines et al. ..... 347/86
2002/0030714 A1 * 3/2002 Walker ..... 347/19
2003/0043243 A1 * 3/2003 Trafton et al. ..... 347/86

FOREIGN PATENT DOCUMENTS

DE 19954749 5/2001
EP 0956962 11/1999

OTHER PUBLICATIONS

RFID Journal 2004- New RFID Tag with more Memory www.rfidjournal.com/article/articleprint/544/-1/1/.
Hungarian Search Report dated Nov. 2, 2005.

* cited by examiner

*Primary Examiner*—Manish S. Shah
*Assistant Examiner*—Laura E Martin
(74) *Attorney, Agent, or Firm*—Larry Baker

(57) ABSTRACT

Embodiments of the present invention include wireless electronic memory devices formed within plugs for sealing the filling ports of containers of consumable substances; containers incorporating the plugs; and related methods.

26 Claims, 6 Drawing Sheets

REPLACEABLE MEMORY DEVICE FOR A CONSUMABLE SUBSTANCE CONTAINER, AND METHODS

FIELD OF INVENTION

This invention relates generally to containers for consumable substances, and more particularly to replaceable containers having integral electronic memory devices.

BACKGROUND OF THE INVENTION

Many types of equipment or devices require a supply of a consumable substance. The substance may be needed for the equipment to operate properly, such as a fuel or lubricant; or the substance may be utilized by the equipment as a component or ingredient in forming a final product or output. Consumable substances may be provided in replaceable containers that are changed when the substance is depleted.

Printers with user-replaceable consumables (and related devices, such as facsimile machines and copiers) are well known in the art. For example, inkjet printers typically utilize replaceable ink supplies, either integrated with a printhead or in the form of separate supplies. In laser printers, toner is typically supplied in a replaceable cartridge, which may include the photosensitive drum on which images are formed.

In manufacturing containers of consumable substances, it is typical to fill the containers at a much more rapid rate than the rate at which the substance is subsequently withdrawn from the container by the utilizing equipment. With ink supplies for printers, for example, one common technique for rapidly filling consumables with ink is to provide a separate filling port on the consumable, sized to accept an ink-fill needle. Ink is then rapidly injected into the container on an assembly line. After the consumable is filled and the needle withdrawn, the filling port is closed, typically with a plug.

It is increasingly common for containers of consumable substances to have integral electronic memory devices, which may be used for a variety of purposes by the utilizing equipment. The memory device may be used as a "keying" feature to differentiate between different substances, may contain calibration information, or may be used to indicate a status condition of the consumable, such as the substance level within the consumable. The memory devices may also be used for many other purposes, such as enabling specialized features of the device or providing other value to the equipment user. While earlier memory devices typically had electrical contacts that had to connect to mating contacts in the utilizing equipment, newer devices are often wireless and rely on radio frequency (RF) communication.

Changes to the physical design of a replaceable container can be prohibitively expensive, both in terms of research and development expense and in the costs of retooling an assembly line. While adding a memory device to an existing line of containers may be desirable, there is also generally a need to maintain backward compatibility to older equipment.

When a memory device is used to differentiate between substantially similar containers having different contents (such as ink supplies containing different ink colors or having different fill levels), it is typically preferable that the differentiation take place as far down the assembly line as possible, such that fewer distinct lines of components need to be dealt with, and greater flexibility exists in the supply chain and manufacturing process.

Further, if a need arises to re-characterize a container after manufacturer (such as, for example, to provide updated information about the consumable substance or to enable new or revised features of the equipment), a simple method of replacing the integral memory device may prove more cost effective than electrically reprogramming the memory device. If an integral memory device on a container has failed, a simple method of replacement can also allow for cost-effective repair of a consumable container.

SUMMARY OF THE INVENTION

Embodiments of the present invention include wireless electronic memory devices formed within plugs or "corking members" for sealing the filling ports of containers of consumable substances; containers incorporating the plugs; and related methods.

Other aspects and advantages of the present invention will become apparent from the following detailed description, taken in conjunction with the accompanying drawings, illustrating by way of example the principles of the invention.

DESCRIPTION OF THE EMBODIMENTS OF THE INVENTION

Embodiments of the invention are described with respect to an exemplary inkjet printing consumable; however, the invention is not limited to the exemplary consumable nor to the field of inkjet consumables, but may be utilized in other consumable substance containers having fill ports.

Figure 1:
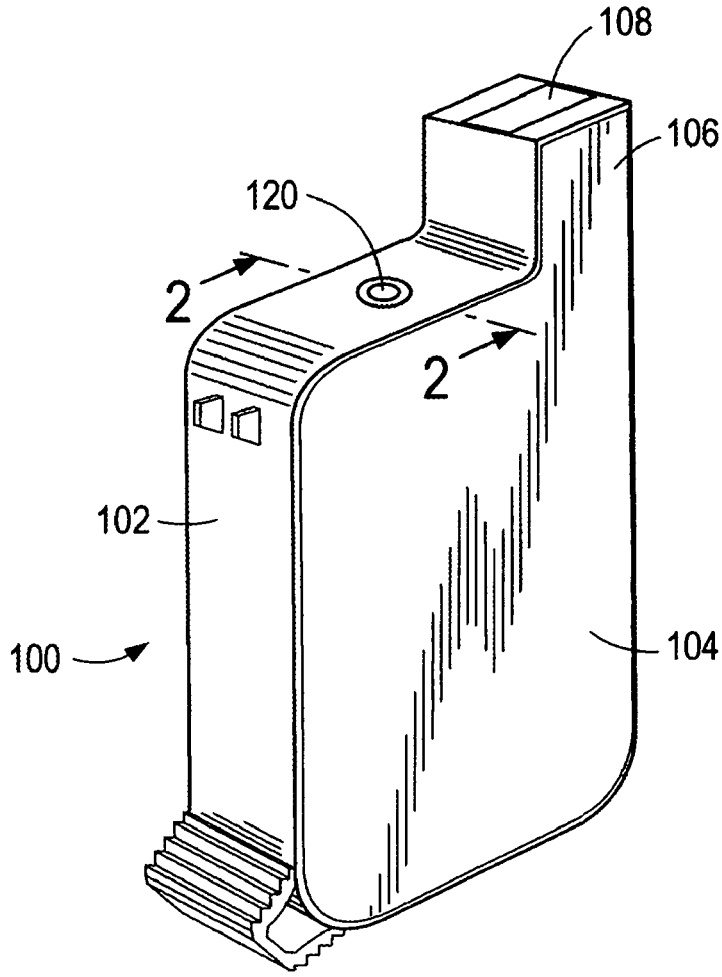
FIG. 1 illustrates an exemplary printer consumable in which embodiments of the invention may be used.

FIG. 1 illustrates an exemplary printer consumable 100 in which embodiments of the invention may be used. The exemplary consumable is of the type that is typically installed on the printing carriage of a printer and which includes an integral printhead, but other types of printing consumables may also utilize the invention, such as, for example, ink containers without printheads that are mounted either on the scanning carriage or remotely located ("off-axis").

The exemplary consumable is shown oriented with the fill port 120 facing up, as the consumable would be oriented during the ink-fill operation. The illustrated consumable is formed of a rigid outer frame 102 onto which metal side pieces 104 are pressed; the consumable has a "snout" region 106 that includes a printhead 108. A circular fill port 120 is provided through the frame 102, allowing the consumable to be filled with liquid ink.

For clarity the exemplary consumable 100 is shown in somewhat simplified form. Embodiments of the exemplary consumable may have a more complex structure, such as, for example, the frame for an ink-jet cartridge described in U.S. Pat. No. 5,737,002 (Swanson et al., TWO MATERIAL FRAME HAVING DISSIMILAR PROPERTIES FOR THERMAL INK-JET CARTRIDGE). Embodiments of the exemplary consumable may also include additional mechanisms, such as mechanisms for regulating backpressure during printing (not shown in FIG. 1).

Figure 2A:
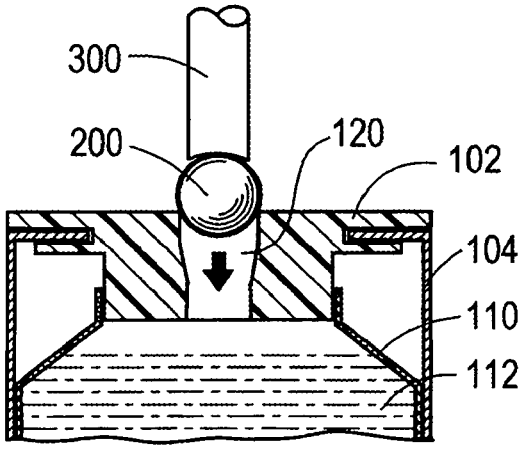
FIGS. 2(*a*) and 2(*b*) are partial cross-sectional views taken along line 2—2 of FIG. 1, illustrating the fill port region of the exemplary consumable during and after the insertion of a corking member.
Figure 2B:
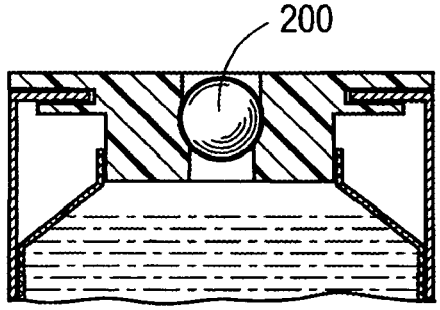

FIGS. 2(*a*) and 2(*b*) are partial cross-sectional views taken along line 2—2 of FIG. 1, illustrating the fill port 120 region of the exemplary consumable. To fill the ink reservoir 112 of the exemplary consumable, the consumable is held with the snout region 106 in an upright position as shown in FIG. 1. A needle (not illustrated) is lowered through the fill port opening 120 down into the ink reservoir 112 nearly touching the bottom of the reservoir. This is done so that the ink falls the shortest distance possible, as some inks will foam if they fall, which makes priming of the printhead difficult. The pen reservoir 112 is then filled with ink through the ink fill needle by a pump to the point that the ink in the reservoir is nearly touching the inside of the ink fill hole 120. At this point the needle is drawn out of the consumable and a corking member 200 is placed over the ink fill port 120, as shown in FIG. 2(*a*). The corking member includes an electronic memory device as discussed below, and may have other forms than a substantially round ball, as also discussed below. Typically both the fill port 120 and corking member 200 have substantially round cross-sections, although other configurations are possible. The corking member fits tightly within the opening 120, and displaces some of the plastic material surrounding the opening 120 as it is inserted, due to its size relative to the opening size. The corking member 120 is pressed into the ink fill 120 by a pressing tool 300 such that it tightly seals the ink fill port. The final position of the corking member 200 within the fill port is shown in FIG. 2(*b*).

Figure 3:
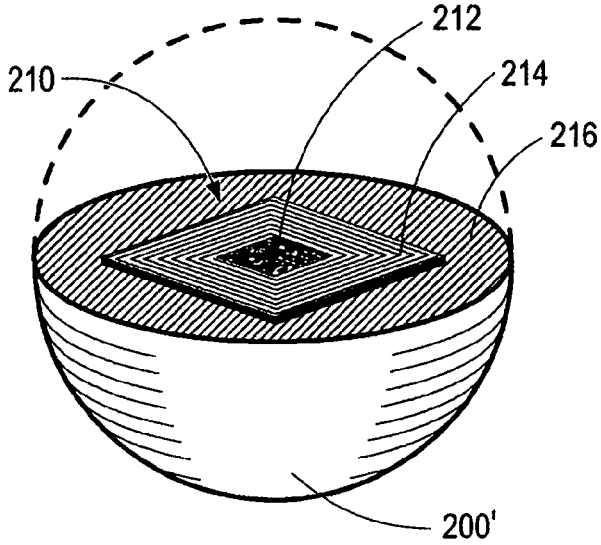
FIG. 3 is a partial cutaway view of an exemplary corking member according to an embodiment of the invention.

FIG. 3 is a partial cutaway view of a corking member 200' according to an embodiment of the invention. As indicated by the dashed line, the upper portion of the body of the corking member is shown in phantom such that the interior is visible. Inside the body of the corking member is an electronic memory device 210 that incorporates radio frequency communication capabilities utilizing technology sometimes referred to as Radio Frequency Identification (RFID).

One exemplary suitable technology for implementing the memory device is Coil-on-Chip™ technology developed by Hitachi Maxell. The exemplary memory device includes an antenna coil 214 mounted on a 2.5 mm square integrated circuit chip; the antenna surrounds electronic circuitry 212 providing power generation, control circuitry, and memory, as described below. With the antenna coil formed on the chip surface, the exemplary electronic memory device 210 may be embedded into the corking member 200' without the need for any additional electronic circuitry or external electrical connections. Other suitable technologies may also be used, including technologies in which the electronic circuitry and antenna are mounted on a common substrate, and technologies utilizing a discrete antenna element.

The exemplary memory device 210 is a Read/Write device with 128 byte total memory which can be written to or read using various RFID reader methods known in the art. Typically, a reader/writer (not shown in FIG. 3) is placed adjacent to the item containing the memory device; the memory device derives both electrical power and data from the RF field generated by the reader/writer. The exemplary memory device operates with a carrier frequency of 13.56 MHz; an operating distance of approximately 0.5 mm to 3 mm (variable depending on the performance of the Reader/Writer or system environment); and a data rate of 26.48 thousand bits-per-second (kbps). The memory of the exemplary device is configured as Electrically Erasable Programmable Read-Only-Memory (EEPROM), although other configurations of memory may be utilized, such as, for example, Read-Only-Memory (ROM) or Programmable Read-Only-Memory (PROM).

Corking member 200' may be produced by molding a suitable material 216 around the memory device 210, or by any of the various packaging methods known in the art.

Figure 4:
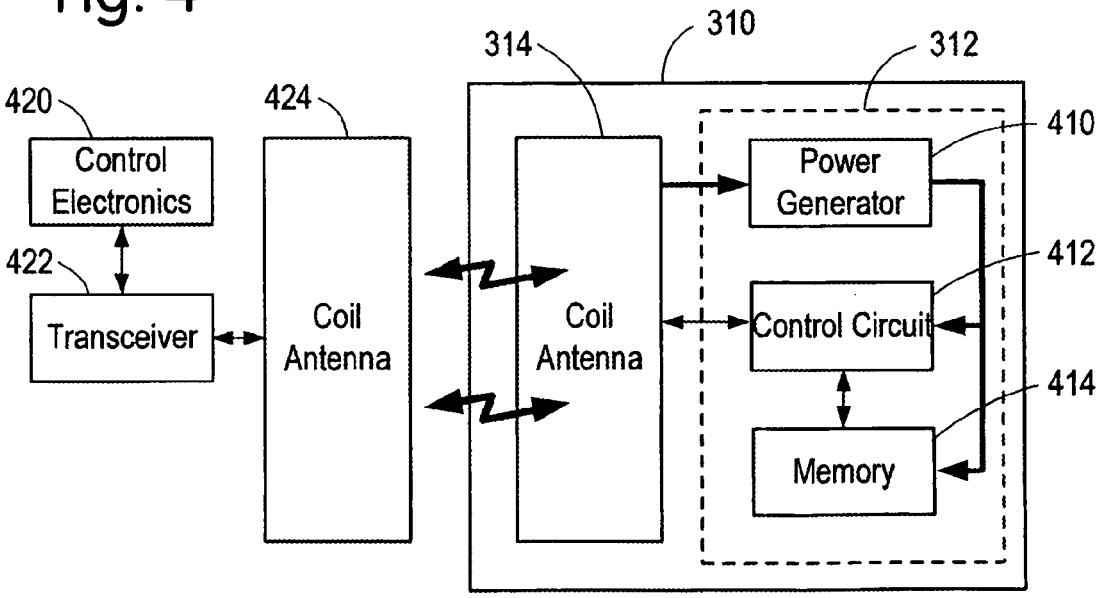
FIG. 4 is an electrical block diagram illustrating the operation of an exemplary memory device.

FIG. 4 is an electrical block diagram illustrating the operation of the exemplary memory device. Contained on the integrated circuit 310 are a coil antenna 314 and the electronic circuitry 312. The electronic circuitry includes a power generation circuit 410 to derive electrical power for the electronic circuitry from the RF field impinging on the antenna; EEPROM 414; and control circuitry 412 to control reading and writing from the EEPROM 414 and to receive data from, and send data to, the antenna.

In operation, control electronics 420 in the device in which the consumable is installed (or in a separate programming or reading station) generate signals to control a transceiver 422 attached to an antenna 424, which generates an RF field that allows reading and writing of data from the memory device 310.

Figure 5:
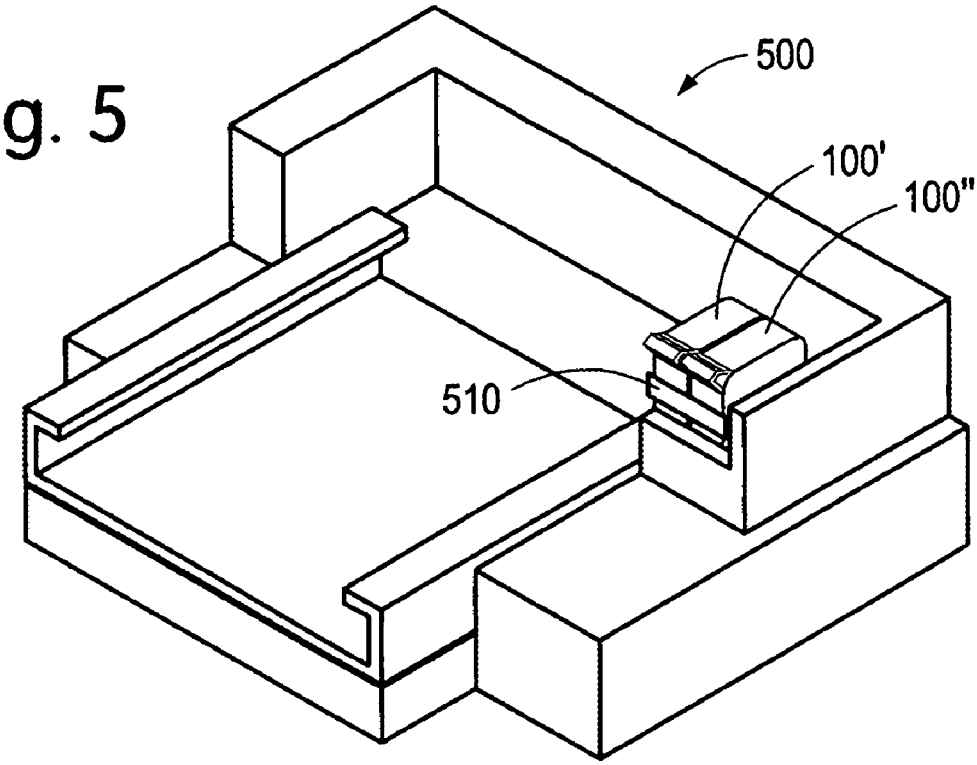
FIG. 5 illustrates an exemplary printing system in which embodiments of the present invention may be used.

FIG. 5 illustrates an exemplary printing system 500 in which embodiments of the present invention may be used. As previously indicated, the invention may also be utilized in printers having different configurations, and with devices other than printers that utilize containers of consumable substances. As indicated in FIG. 5, one or more containers 100', 100" may typically be installed in a scanning carriage 510 of the exemplary printer; the carriage is scanned across print media as ink or other fluids are deposited on the media.

Figure 6:
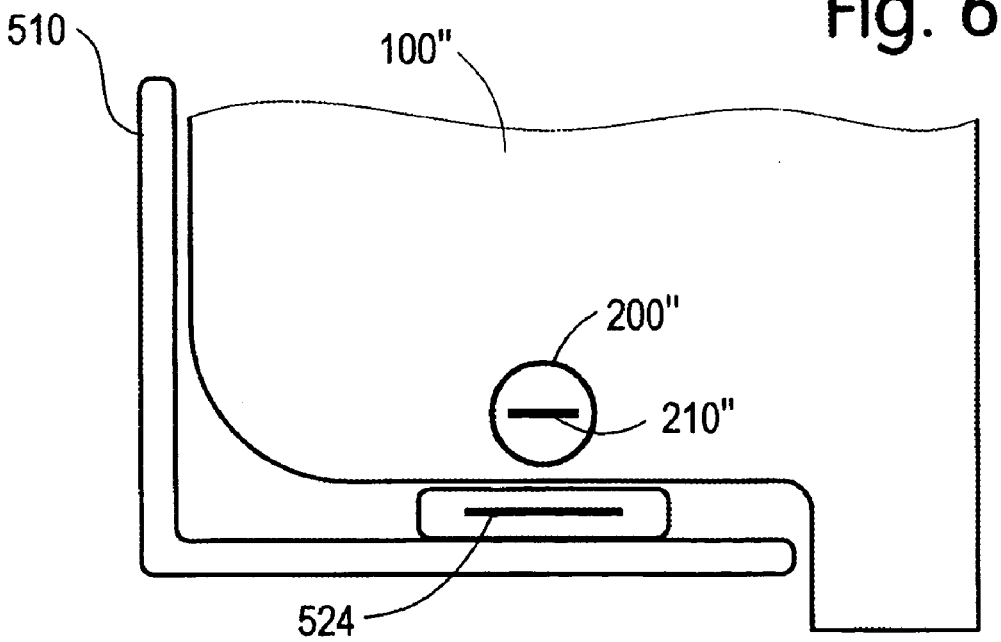
FIG. 6 illustrates in schematic form how an antenna mounted within the exemplary printer is located in close proximity to the memory device, and is aligned with the antenna of the memory device.

FIG. 6 illustrates in schematic form how an antenna coil 524 mounted on the scanning carriage of the exemplary printer is located in close proximity to the memory device 210" contained within the corking member 200" (for clarity, the consumable container 100" and corking member 200" are not shown to scale). As described with respect to FIG. 4, antenna coil 524 is connected to a transceiver (not shown in FIG. 6) located within the printer. For optimal operation, the antenna of the memory device 210" is maintained in a proper alignment with the antenna on the scanning carriage, with the coil antennas substantially parallel, since communication is degraded if the antenna coils are not properly aligned. For types of consumables not mounted on a scanning carriage, antenna coil 524 is mounted in any appropriate location providing close proximity and proper alignment to the consumable fill port.

Figure 7A:
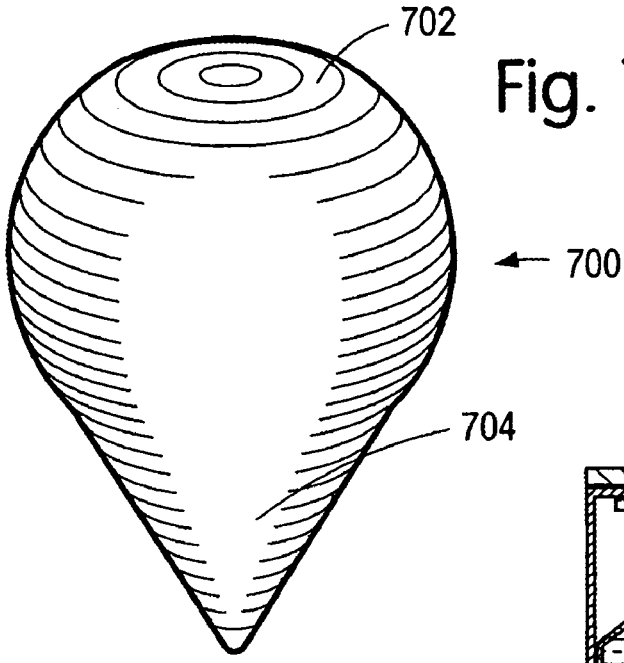
FIGS. 7(*a*) and 7(*b*) illustrate one approach that may be utilized to physically insure that the exemplary corking member maintains a correct alignment when placed in the fill port.
Figure 7B:
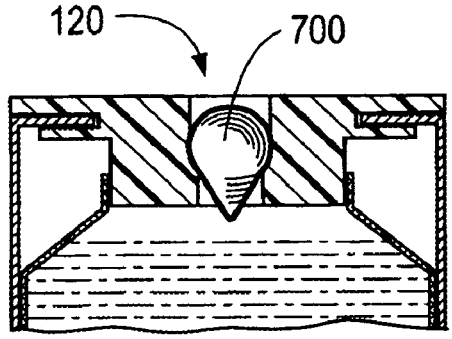

FIGS. 7(*a*) and 7(*b*) illustrate one approach that may be utilized to physically insure that the exemplary corking member 700 maintains a correct alignment when placed in the fill port 120. As shown in FIG. 7, the leading portion 704 of the corking member is elongated, insuring that the corking member is correctly aligned for installation into the fill port, and does not rotate out of alignment as it is inserted. The cross-section of the exemplary corking member 700 is typically round, as discussed above. The trailing portion 702 of the corking member may be substantially the same as shown in previous figures.

Figure 8A:
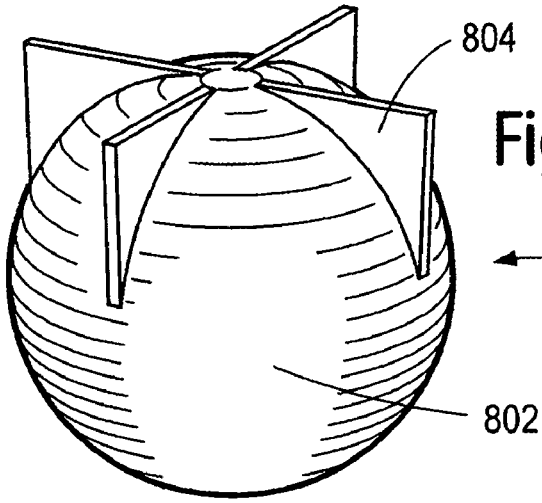
FIGS. 8(*a*) and 8(*b*) illustrate another approach that may be utilized to physically insure that the exemplary corking member maintains a correct alignment when placed in the fill port.
Figure 8B:
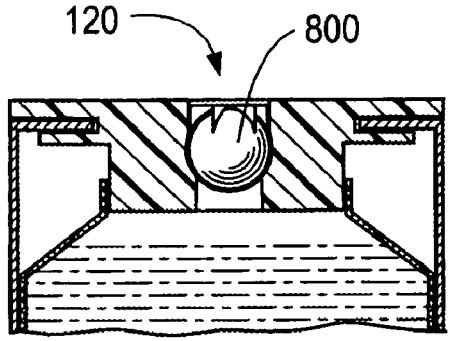
Figure 9A:
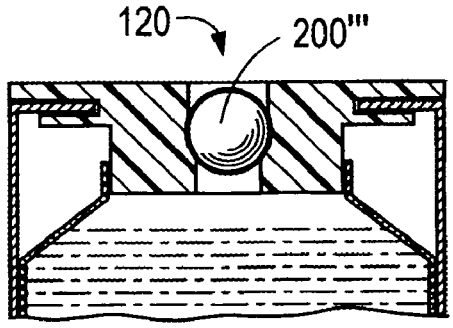
FIGS. 9(*a*), 9(*b*), 9(*c*), and 9(*d*) illustrate how one corking member 200''' previously placed in a fill port 120 may be replaced with a new corking member 700' according to an embodiment of the invention.
Figure 9B:
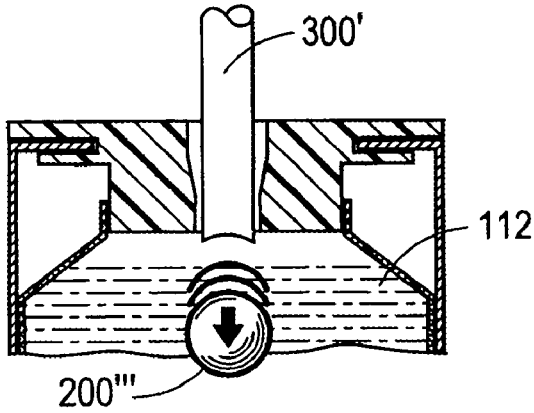
Figure 9C:
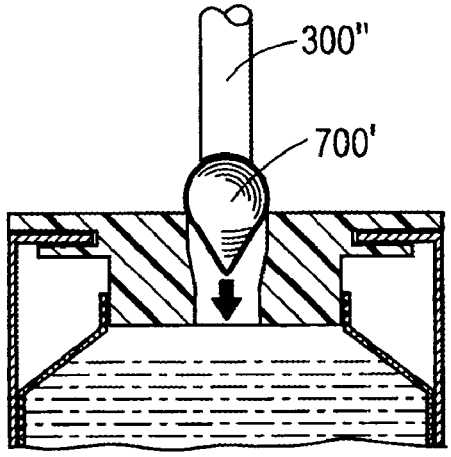
Figure 9D:
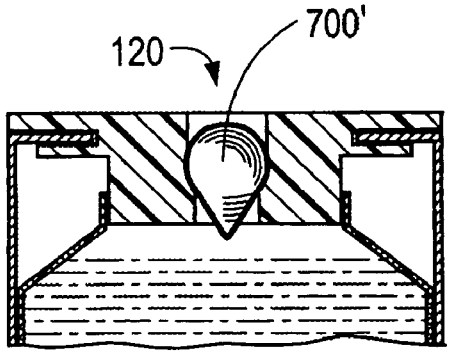

Alternatively, FIGS. 8(*a*) and 8(*b*) illustrate how "fins" or protuberances 804 may be provided on the trailing portion of the corking member 800, with the leading portion 802 substantially the same as shown in FIGS. 2, 3, and 6. The fins 804 also ensure that the corking member maintains a correct alignment with the fill port 120.

Combinations of the leading and trailing features as shown in FIGS. 7 and 8 may also be utilized; or any other physical alignment feature that ensures the correct alignment of the corking member with the fill port. In new container designs, the fill port may be configured help correctly align the corking member, such as by shaping the sides of the fill port to facilitate alignment (not shown). Embodiments of the corking member may lack physical alignment features, such as the ball-shaped members shown in FIGS. 2(*a*), 2(*b*), and 3, provided that the insertion process for the corking member into the fill port reliably provides for proper alignment.

FIGS. 9(*a*), 9(*b*), 9(*c*), and 9(*d*) illustrate how one corking member 200''' previously placed in a fill port 120 may be replaced with a new corking member 700' according to an embodiment of the invention. Replacement may be effectuated to replace a defective memory device with a properly operating device, to upgrade or change the contents of the memory device by physically replacing it, or to provide a memory device on a container that previously lacked a memory device.

As seen in FIG. 9(*a*), previously installed corking member 200'' is in fill port 120. In FIG. 9(*b*), pressing tool 300' pushes the previously installed corking member out of the fill port and into the fluid reservoir 112. Assuming that previously installed corking member 200'' includes a functioning memory device, the corking member 200'' will now be too distant from a read/write antenna placed adjacent to the fill port to be accessed. In FIG. 9(*c*), pressing too 300'' is utilized to press new or replacement corking member 700' into the fill port; In FIG. 9(*d*) new or replacement corking member 700' is seen installed in the fill port.

Other methods of replacing the corking member may also be utilized, such as withdrawing the corking member out of the fill port (not shown).

Some types of containers for consumable substances have a fill port that is sealed in some other fashion than the insertion of a corking member, such as, for example, the placement of a sealing tape or label over the fill port. A memory device according to the present invention may be added to these containers by removing the sealing tape or label, if necessary, and pressing a corking member into the fill port as depicted in FIGS. 9(*c*) and 9(*d*).

Figure 10:
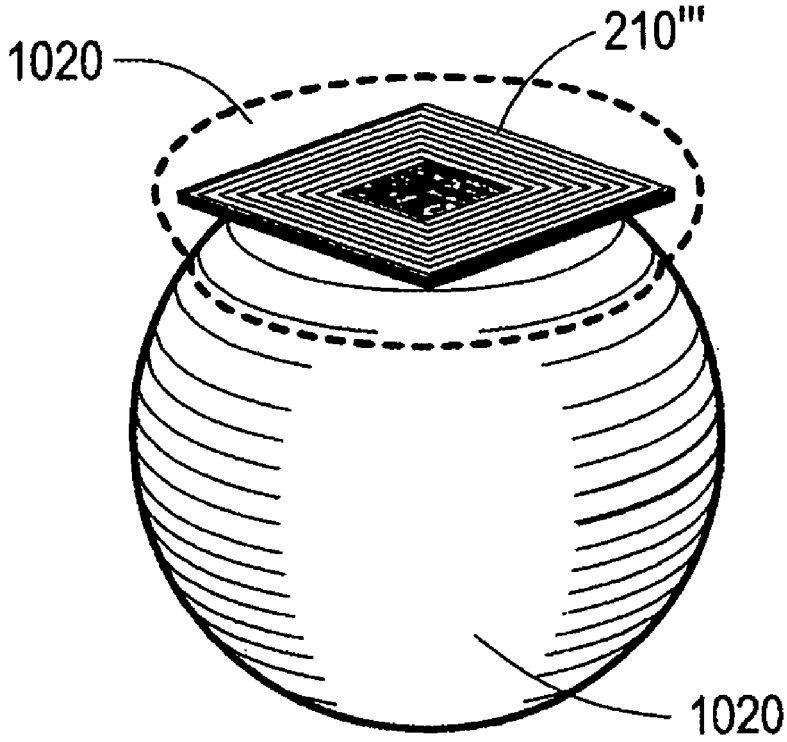
FIG. 10 illustrates an alternative exemplary corking member, according to a further embodiment of the invention.

FIG. 10 illustrates an alternative embodiment of a corking member, in which a memory device 210''' is externally attached to a corking member 1000. The memory device may be adhered to the corking member and encapsulated by a material 1020 such as epoxy. Alternatively, the memory device may be packaged according to any of the packaging methods known in the art, with the package then adhered to the corking member (not shown).

The above is a detailed description of particular embodiments of the invention. It is recognized that departures from the disclosed embodiments may be within the scope of this invention and that obvious modifications will occur to a person skilled in the art. It is the intent of the applicant that the invention include alternative implementations known in the art that perform the same functions as those disclosed. This specification should not be construed to unduly narrow the full scope of protection to which the invention is entitled.

The corresponding structures, materials, acts, and equivalents of all means or step plus function elements in the claims below are intended to include any structure, material, or acts for performing the functions in combination with other claimed elements as specifically claimed.

What is claimed is:

1. A container for a consumable substance, comprising:
a reservoir for a consumable substance;
a fill port; and
a replaceable memory device positioned in the fill port, the replaceable memory device comprising
a body, the body shaped to plug the fill port; and
a wireless electronic memory device integral with the body.

2. The container for a consumable substance of claim 1, wherein the wireless electronic memory device is contained within the body.

3. The container for a consumable substance of claim 1, wherein the body has a substantially round cross-section.

4. The container for a consumable substance of claim 1, wherein the body has a physical alignment feature.

5. The container for a consumable substance of claim 4, wherein the body has a leading portion, and the alignment feature comprises an elongation of the leading portion.

6. The container for a consumable substance of claim 4, wherein the body has a trailing portion, and the physical alignment feature comprises at least one protuberance on the trailing portion.

7. The container for a consumable substance of claim 1, wherein the wireless electronic memory device further comprises Electrically Erasable Programmable Read-Only-Memory (EEPROM).

8. The container for a consumable substance of claim 1, wherein the wireless electronic memory device further comprises Read-Only-Memory (ROM).

9. The container for a consumable substance of claim 1, wherein the wireless electronic memory device further comprises Programmable Read-Only-Memory (PROM).

10. The container for a consumable substance of claim 1, wherein the wireless electronic memory device further comprises an antenna.

11. The container for a consumable substance of claim 1, wherein the electronic memory device further comprises electronic circuitry and a coil antenna formed on a integrated circuit chip.

12. The container for a consumable substance of claim 1, wherein the electronic memory device is eternally attached to the body.

13. A container for a consumable substance, comprising:
a reservoir for a consumable substance;
a fill port; and
a replaceable memory device positioned in the fill port, the replaceable memory device comprising:

a body, the body shaped to plug the fill port, the body having a substantially round cross-section and a physical alignment feature; and a wireless electronic memory device integral with the body, the wireless electronic device further comprising an antenna.

14. The container for a consumable substance of claim 13, wherein the body has a leading portion, and the alignment feature comprises an elongation of the leading portion.

15. The container for a consumable substance of claim 13, wherein the body has a trailing portion, and the physical alignment feature comprises at least one protuberance on the trailing portion.

16. The container for a consumable substance of claim 13, wherein the wireless electronic memory device further comprises Electrically Erasable Programmable Read-Only-Memory (EEPROM).

17. The container for a consumable substance of claim 13, wherein the wireless electronic memory device further comprises Read-Only-Memory (ROM).

18. The container for a consumable substance of claim 13, wherein the wireless electronic memory device further comprises Programmable Read-Only-Memory (PROM).

19. The container for a consumable substance of claim 13, wherein the electronic memory device further comprises electronic circuitry and a coil antenna formed on a integrated circuit chip.

20. A method of installing an electronic memory device in a container for a consumable substance, the container having a fill port, the method comprising:

placing a corking member in the fill port, the corking member comprising a body shaped to seal the fill port, and an electronic memory device.

21. The method of installing an electronic memory device in a container for a consumable substance of claim 20, wherein the electronic memory device is contained within the body.

22. The method of installing an electronic memory device in a container for a consumable substance of claim 20, wherein the electronic memory device further comprises radio frequency communication circuitry.

23. A method of replacing an electronic memory device in a container for a consumable substance, the container having a fill port, a reservoir for a consumable substance, and a first corking member in the fill port, the first corking member comprising a body shaped to seal the fill port and an electronic memory device, the method comprising:

removing the first corking member from the fill port, and placing a second corking member in the fill port, the second corking member comprising a body shaped to seal the fill port, and an electronic memory device.

24. The method of replacing an electronic memory device in a container for a consumable substance of claim 23, wherein removing the first corking member comprises pushing the first corking member from the fill port into the reservoir for a consumable substance.

25. The method of replacing an electronic memory device in a container for a consumable substance of claim 23, wherein the electronic memory device is contained within the body.

26. The method of replacing an electronic memory device in a container for a consumable substance of claim 23, wherein the electronic memory device further comprises radio frequency communication circuitry.

* * * * *

UNITED STATES PATENT AND TRADEMARK OFFICE

CERTIFICATE OF CORRECTION

PATENT NO. : 7,175,266 B2
APPLICATION NO. : 10/769336
DATED : February 13, 2007
INVENTOR(S) : Brian L. Helterline It is certified that error appears in the above-identified patent and that said Letters Patent is hereby corrected as shown below:

In column 6, line 61, in Claim 12, delete “eternally” and insert -- externally --, therefor.

Signed and Sealed this

Second Day of December, 2008

JON W. DUDAS
*Director of the United States Patent and Trademark Office*